United States Patent [19]

Breckenfeld et al.

[11] Patent Number: 4,979,918

[45] Date of Patent: Dec. 25, 1990

[54] OUTBOARD MOTOR VIBRATION ISOLATION SYSTEM

[75] Inventors: Paul W. Breckenfeld, Winthrop Harbor; George L. Broughton, Zion; William D. Dunham, Waukegan, all of Ill.

[73] Assignee: Outboard Marine Corporation, Waukegan, Ill.

[21] Appl. No.: 316,285

[22] Filed: Feb. 27, 1989

[51] Int. Cl.[5] ..... B63H 21/30

[52] U.S. Cl. ..... 440/52; 440/900

[58] Field of Search ..... 440/52, 111, 900; 248/634–643, 231.9, 231.91; 411/75, 80; 267/141.2

[56] References Cited

U.S. PATENT DOCUMENTS

| | | | |
|---|---|---|---|
| 2,740,368 | 4/1956 | Irgens et al. | 115/18 |
| 2,911,936 | 11/1959 | Kiekhaefer | 115/17 |
| 2,916,007 | 12/1959 | Kiekhaefer | 115/18 |
| 3,002,489 | 10/1961 | Watkins | 115/18 |
| 3,127,866 | 4/1964 | Mohr | 115/17 |
| 3,358,668 | 12/1967 | Post et al. | 123/198 |
| 3,599,594 | 8/1971 | Taipale | 115/17 |
| 3,750,615 | 8/1973 | Haft et al. | 115/18 |
| 3,782,321 | 1/1974 | Ellingsen | 115/17 |
| 3,934,537 | 1/1976 | Hall | 115/17 |
| 4,452,332 | 6/1984 | Ping et al. | 180/312 |
| 4,507,090 | 3/1985 | Kobayashi et al. | 440/52 |
| 4,546,848 | 10/1985 | Iijima et al. | 180/312 |
| 4,625,939 | 12/1986 | Bergelt | 248/638 |
| 4,714,132 | 12/1987 | Hattori et al. | 180/312 |

FOREIGN PATENT DOCUMENTS

| | | | |
|---|---|---|---|
| 543090 | 7/1957 | Canada | 440/52 |
| 0126794 | 8/1982 | Japan | 440/52 |

OTHER PUBLICATIONS

Pages from 1985 Mercury V-6 Manual.
Pages from 1986 OMC Parts Catalog.

*Primary Examiner*—Joseph F. Peters, Jr.
*Assistant Examiner*—Edwin L. Swinehart
*Attorney, Agent, or Firm*—Michael, Best & Friedrich

[57] ABSTRACT

Disclosed herein is a marine propulsion device comrising a propulsion unit including a cavity defined in part by a wall, an opening communicating with the cavity, a rubber mount insertable into the cavity through the opening, and an expandible wedge insertable through the opening and into the cavity, securable to the propulsion unit, and engageable with the rubber mount for fixedly securing the rubber mount to the propulsion unit and between the insertable expandible wedge and the wall of the cavity.

14 Claims, 1 Drawing Sheet

OUTBOARD MOTOR VIBRATION ISOLATION SYSTEM

BACKGROUND OF THE INVENTION

The invention relates generally to marine propulsion devices. The invention also relates to vibration isolating and propulsion unit supporting systems for marine propulsion devices.

Attention is directed to the following United States patents.

Irgens, et al.: 2,740,368; Apr. 3, 1956.
Kiekhaefer: 2,911,936; Nov. 10, 1959.
Kiekhaefer: 2,916,007; Dec. 8, 1959.
Watkins: 3,002,489; Oct. 3, 1961.
Mohr: 3,127,866; Apr. 7, 1964.
Post: 3,358,688; Dec. 19, 1967.
Taipale: 3,599,594; Aug. 17, 1971.
Haft: 3,750,615; Aug. 7, 1973.
Ellingsen: 3,782,321; Jan 1, 1974.
Hall: 3,934,537; Jan. 27, 1976.
Iijima, et al.: 4,546,848; Oct. 15, 1985.
Bergelt: 4,625,939; Dec. 2, 1986.
Hattori, et al.: 4,714,132; Dec. 22, 1987.
Ping, et al.: 4,452,332; June 5, 1984.

SUMMARY OF THE INVENTION

The invention provides a marine propulsion device comprising a propulsion unit including a cavity defined in part by a wall, means for defining an opening communicating with the cavity, a rubber mount insertable into the cavity through the opening, and means insertable through the opening and located in the cavity, securable to the propulsion unit, and engageable with the rubber mount for fixedly securing the rubber mount to the propulsion unit and between the insertable means and the wall of the cavity.

In one embodiment of the invention, the cavity includes a front shoulder and a rear shoulder, and the wall extends between the front and rear shoulders, and the rubber mount is located, at least in part, between the the front and rear shoulders and in engagement with the wall by the insertable means.

The invention also provides a marine propulsion device comprising a propulsion unit including a cavity having a pair of internal side walls spaced at a dimension, means for defining an opening communicating with the cavity and having a dimension which extends parallel to the dimension between the side walls and which is less than the dimension between the side walls, a pair of rubber mounts insertable into the cavity through the opening and respectively located in the cavity adjacent the side walls, means insertable through the opening and located between said rubber mounts for engagement with the rubber mounts to secure the rubber mounts in engagement with the side walls, and means for releasably connecting the insertable means to the propulsion unit.

In one embodiment in accordance with the invention, the insertable means comprises a pair of wedge-shaped blocks located between the rubber mounts, which blocks each include a side surface and a wedge surface in inclined relation to the side surface, which inclined surfaces are in engagement, and means for displacing the blocks relative to each other and along the inclined surfaces to increase the distance between the side surfaces and to engage the side surfaces of the blocks with the rubber mounts so as to secure the rubber mounts between the side walls of the cavity and the side surfaces of the blocks.

In one embodiment of the invention, the rubber mounts each include an outer shell having a cylindrical outer surface defined by a radius, the side walls of the cavity are generally semi-cylindrical in shape and have a radius substantially equal to the outer surface radius, and the side surfaces of the blocks are generally semi-cylindrical in shape and have a radius substantially equal to the outer surface radius.

In one embodiment of the invention, the means for displacing the blocks relative to each other comprises a rear wall located in the cavity and having therein a threaded hole, a rear end wall on one of the blocks and located adjacent the cavity rear wall, a front end wall on the other of the blocks, aligned apertures in the blocks and extending from the front end wall to the rear end wall, and a bolt including a head engaging the front end wall, and a shank passing through the aligned apertures and including a threaded portion threadedly engaged in the threaded hole in the rear wall.

The invention also provides a marine propulsion device comprising a propulsion unit including a cavity having a pair of internal side walls spaced at a first dimension and being substantially semi-cylindrical in shape and defined by a first radius, and a rear wall having a threaded hole, means for defining an opening communicating with the cavity and having a dimension which extends parallel to the dimension between the side walls and which is less than the dimension between the side walls, a pair of rubber mounts insertable into the cavity through the opening and respectively located in the cavity adjacent the side walls, which rubber mounts each include an outer shell having a cylindrical outer surface defined by a second radius substantially equal to the first radius, a central core having therein an axially extending aperture with a forward threaded end adapted to be connected to an arm of a kingpin, and a rearward threaded end, and a stop member having a shank threaded into the rearward end of the core and an enlarged head portion including a peripheral part located for engagement with the cavity to prevent withdrawal of the core from the cavity independently of the remainder of the rubber mount, a pair of wedge-shaped blocks insertable through the opening and located between the rubber mounts, each of the blocks including a side surface of substantially semi-cylindrical shape with a third radius substantially equal to the first radius, and a wedge surface in inclined relation to the side surface, which inclined wedge surfaces are in engagement, one of the blocks including a rear end wall located adjacent the cavity rear wall, the other of the blocks including a front end wall, aligned apertures in the blocks and extending from the front end wall to the rear end wall, and a bolt including a head engaging the front end wall, and a shank passing through the aligned apertures and including a threaded portion threadedly engaged in the threaded hole in the rear wall, whereby to afford lateral displacement of the blocks relative to each other so as to increase the distance between the side surfaces and to engage the side surfaces of the blocks with the rubber mounts to secure the rubber mounts between the side walls of the cavity and the side surfaces of the blocks.

Other features and advantages of the invention will become apparent to those skilled in the art upon review of the following detailed description, claims, and drawings.

THE DRAWINGS

Figure 1:
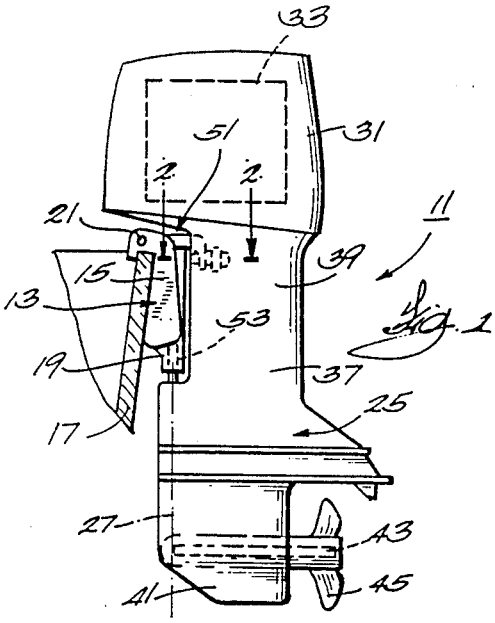
FIG. 1 is a side elevational view of a marine propulsion device embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a marine propulsion device in the form of an outboard motor 11, which outboard motor includes a boat mounting assembly 13 including a transom bracket 15 adapted to be mounted on a boat transom 17 and a swivel bracket 19 which is pivotally connected to the transom bracket 15 for pivotal movement relative to the transom bracket 15 about a tilt axis 21 which is normally horizontal when the outboard motor 11 is boat mounted.

The outboard motor 11 also includes a propulsion unit 25 which is pivotally connected to the swivel bracket 19 for tilting movement in common with the swivel bracket 19 relative to the transom bracket 15 and for pivotal steering movement relative to the swivel bracket 19 about a steering axis 27 which is transverse to the tilt axis 21.

Figure 2:
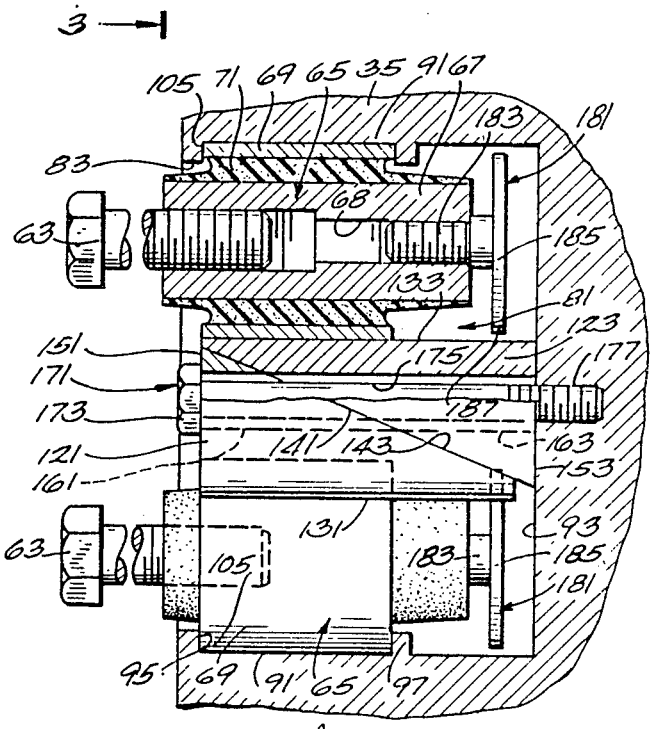
FIG. 2 is a fragmentary enlarged sectional view taken along line 2—2 of FIG. 1.

The propulsion unit 25 includes a rigid assembly which comprises a powerhead 31 including an internal combustion engine 33 having (See FIG. 2) an engine block 35, and a drive shaft housing 39 having an upper end fixed to the engine block 35, and a lower end fixed to a gear case 41 which supports a propeller shaft 43 driven by the engine 33 and carrying a propeller 45.

The arrangement for pivotally connecting the propulsion unit 25 to the swivel bracket 19 includes a kingpin 51 which extends into a bore 53 in the swivel bracket 19 and which, at its upper and lower ends, is secured to the propulsion unit 25 by suitable vibration isolation means. More specifically, at the upper end of the kingpin 51, a pair of arms 63 (See FIG. 2) extend rearwardly and are respectively connected to a pair of rubber mounts 65 which, in turn, are suitably secured to the propulsion unit 25 so to both vibrationally isolate the propulsion unit 25 from the mounting assembly 13 while, at the same time, supporting the propulsion unit 25 from the mounting assembly 13.

Still more specifically, the rubber mounts 65 are generally identical and each includes a cylindrical central core 67 which can be fabricated from metal and has a central bore 68, and a cylindrical outer shell 69 which can also be fabricated from metal, both of which are bonded to an intervening elastomeric member 71.

The central cores 67 are respectively fixedly assembled onto the extending arms 63 of the kingpin 51 and the outer shells 69 are suitably secured to the propulsion unit 25.

As thus far disclosed, the construction is conventional.

In the disclosed construction, the arrangement for vibrationally isolating and supporting the propulsion unit 25 from the mounting assembly 13 includes provision of a cavity 81 formed in the propulsion unit 25 and including an interior wall, together with an opening 83 which communicates with the cavity 81 and affords entry of at least one rubber mount 65 into the cavity 81, and means insertable through the opening 83 and into the cavity 81, securable to the propulsion unit 25, and engageable with the rubber mount 65 for fixedly securing the rubber mount 65 to the propulsion unit 25 and between the insertable means and the interior wall of the cavity 81.

The internal cavity 81 includes spaced side walls 91 which preferably are semi-cylindrical and which are laterally spaced apart at a distance greater than twice the diameter of the outer shells 69. The cavity also includes a rear wall 93, a forward wall 95, and intermediate shoulders 97 respectively projecting inwardly of the cavity 81 from the side walls 91 at a distance from the front wall 95 approximately equal to the axial length of the outer shells 69.

Figure 3:
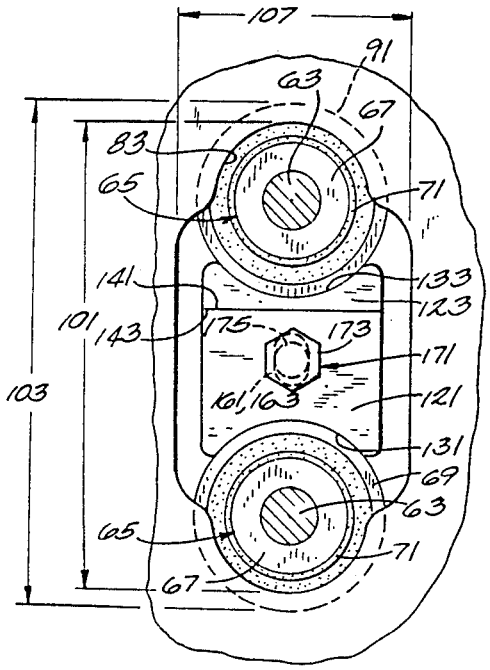
FIG. 3 is a sectional view taken along line 3—3 of FIG. 2.

The arrangement for suitably securing the rubber mounts 65 to the propulsion unit 25 also includes provision of the access or entry opening 83 through the front wall 95 from the exterior of the propulsion unit 25 into the internal cavity 81 for the purpose of permitting insertion through the opening 83 of the rubber mounts 65 into the internal cavity 81. In this regard, the opening has (See FIG. 3) a lateral dimension 101 which is greater than the diameter of the outer shells 69 but less than the distance or dimension 103 between the side walls 91 of the cavity 81, thereby forming the front wall 95 with a lip, or flange, or shoulder 105 extending from the forward end of the semi-cylindrical side walls 91 of the internal cavity 81.

The opening 81 also has a vertical extent 107 greater than the diameter of the outer shells 69, whereby the rubber mounts 65 can be inserted through the opening 83 and into the cavity 81, with the outer shells 69 of the rubber mounts 65 being thereafter respectively located in nested snug engagement with the semi-cylindrical side walls 91 and between the shoulders 97 and the lip or flange or shoulder 105 at the front of the cavity 81. In this position, the outer shells 69 are engaged by the cavity 81 to prevent relative movement therebetween.

The arrangement for securing the rubber mounts 65 to the propulsion unit 25 also includes a means for tightly securing the rubber mounts 65 in fixed relation with the propulsion unit 25. While other constructions can be employed, in the disclosed construction, such means comprises locating and securing means which is insertable through the opening 83 into the internal cavity 81. While other constructions can be employed for such locating and securing, in the disclosed construction, such means comprises a pair of wedge-shaped members or blocks 121 and 123 respectively constituting front and rear blocks. The blocks 121 and 123 respectively include side walls or surfaces 131 and 133 which preferably are concavely semi-cylindrical and which are adapted to snugly engage the outer shells 69. In addition, the blocks 121 and 123 respectively include inclined surfaces 141 and 143 which are slidably engaged with each other. In addition, the front block 121 includes a front end wall 151 and the rear block 123 includes a rear end wall 153 adapted to engage the rear wall 93 of the cavity 81.

Means are also provided for releasably securing the blocks 121 and 123 to the propulsion unit 25 and for displacing the blocks 121 and 123 relative to each other and along the inclined surfaces 141 and 143 to, in effect, outwardly displace the concave side surfaces 131 and 133 away from each other and into snug engagement with the outer shells 69 of the rubber mounts 65, which outward displacement also serves to snugly engage or secure the outer shells 69 of the rubber mounts 65 in the semi-cylindrical side walls 91 of the internal cavity 81 and between the shoulders 97 and 105, thereby fixedly locating the rubber mounts 65 relative to the propulsion unit 25.

While other constructions can be employed, in the disclosed construction, such means for releasably securing the blocks 121 and 123 and displacing the blocks 121 and 123 relative to each other comprises the inclined relation of the mating or inclined wedge surfaces 141 and 143, and respective cooperating and aligned apertures 161 and 163 in the blocks or wedges 121 and 123, together with a bolt 171 having an enlarged head 173 which engages the front end surface 151 of the front block 121, a shank 175 which extends through the aligned apertures 161 and 163 in the blocks 121 and 123 and which is threaded into an aperture or hole 177 in the rear wall 93 of the cavity 81. Consequently, axial movement of the head 173 toward the rear wall 93 of the cavity 81 in response to rotation of the bolt 171 serves to seat the rear end surface 153 of the rear block 123 against the rear wall 93 of the internal cavity 81 and to slide the front block 121 rearwardly along the inclined surface 143 of the rear block 123, thereby outwardly displacing the blocks 121 and 123 relative to each other and into engagement with the outer shells 69 of the rubber mounts 65 and as so as to tightly secure the rubber mounts 65 to the propulsion unit 25.

While the internal cavity 81 has thus far been disclosed as being provided in the propulsion unit 25, it is preferred to locate the internal cavity 81 in the front of the engine block 35. In this regard, the cavity 81 can be provided during casting of the engine block 35. However, if desired, the internal cavity 81 can be provided at the front of the drive shaft housing 39.

Means are provided for preventing withdrawal of the inner cores 67 of the rubber mounts 65 outwardly of the remainder of the rubber mounts and outwardly of the cavity 81 in response to an unexpected heavy loading on the vibration isolation and propulsion unit supporting arrangement. While other constructions can be emploYed, in the disclosed construction, each bore 68 has a rearward end 183 threadedly receiving a stop member 181 comprising a shank 183 having a threaded forward end received in the rear end of the bore 68, and a rearward end joined to an enlarged head 185 having a radially outwardly extending peripheral part 187 located between the rear wall 93 and the interior shoulder 97 such that excessive outward movement of the metallic core 67 would result in abutting interference to movement of the peripheral part 187 of the stop member 181 past the intermediate shoulder 97, thereby preventing unintended withdrawal of the inner core 67 from the rubber mounts 65 and from the cavitY 81.

If desired, a shoulder (not shown) can also be provided on each of the blocks or wedges 121 and 123 for interference with withdrawal of the stop member 151, thereby also aiding in preventing withdrawal of the inner cores 67 from the remainder of the rubber mounts 65 and from the cavity 81.

At the other or forward end thereof, the bore 68 in the inner core 67 of the rubber mount 65 is suitably threaded to receive the rearward end of an associated arm 63 extending from the kingpin 51.

In assembling the king pin 51 to the propulsion unit 25, the rubber mounts 65 are first inserted into the cavity 81 through the opening 83, followed by insertion of the rearward block 123, and then the forward block 121, and by insertion of the bolt 171 through the apertures 177 to threadedly engage the bolt 171 in the rearward wall 93 of the cavity 81. Axial movement of the bolt 171 in response to increasing threaded engagement causes the front block 121 to slide on the rear block 123 and causes the blocks 121 and 123 to move laterally outwardly relative to each other, thereby capturing the outer shells 69 of the rubber mounts 65 between the side walls 91 of the cavitY 81 and the side surfaces 131 and 133 of the blocks 121 and 123 and between the intermediate and front shoulders 97 and 105. The arms 63 can then be threaded into the inner cores 67 of the rubber mounts 65 and, at their outer ends, bolted to the kingpin 51.

Various of the features of the invention are set forth in the following claims.

We claim:

1. A marine propulsion device comprising a propulsion unit including a rigid assembly which comprises a power head and a drive shaft housing and which includes therein a cavity defined in part by a wall, means defining an opening communicating with said cavity, a rubber mount inserted into said cavity through said opening, and means having dimensions affording insertion through said opening and located in said cavity, secured to said propulsion unit independently of said rubber mount, and engaging said rubber mount for fixedly securing said rubber mount to the propulsion unit and between said inserted means and said wall of said cavity.

2. A marine propulsion device in accordance with claim 1 wherein said cavity includes a front shoulder and a rear shoulder, and wherein said wall extends between said front and rear shoulders, and wherein said rubber mount is located, at least in part, between said front and rear shoulders and in engagement with said wall by said inserted means.

3. A marine propulsion device as set forth in claim 1 and further comprising a kingpin engaging said rubber mount independently of said inserted means so that said propulsion unit is supported relative to said kingpin by said rubber mount.

4. A marine propulsion device comprising a propulsion unit including a cavity defined in part by a wall, means defining an opening communicating with said cavity, a rubber mount insertable into said cavity through said opening, means insertable through said opening and located in said cavity, securable to said propulsion unit, and engageable with said rubber mount for fixedly securing said rubber mount to the propulsion unit and between said insertable means and said wall of said cavity, said insertable means comprising a pair of wedge-shaped blocks, each of said blocks including a side surface and a wedge surface in inclined relation to said side surface, said inclined wedge surfaces being in engagement, and means for displacing said blocks relative to each other and along said inclined surfaces to increase the distance between said side surface and to engage said side surface of one of said blocks with said rubber mount so as to secure said rubber mount between said wall of said cavity and said side surface of said one of said blocks.

5. A marine propulsion device in accordance with claim 4 wherein said rubber mount includes an outer shell having a cylindrical outer surface defined by a radius, wherein said wall of said cavity is generally semi-cylindrical in shape and has a radius, substantially equal to said outer surface radius, and wherein said side surface of said one of said blocks is generally semi-cylindrical in shape and has a radius substantially equal to said outer surface radius.

6. A marine propulsion device in accordance with claim 3 wherein said means for displacing said blocks relative to each other comprises a rear wall located in said cavity and having therein a threaded hole, a rear end wall on one of said blocks and located adjacent said cavity rear wall, a front end wall on the other of said blocks, aligned apertures in said blocks and extending from said front end wall to said rear end wall, and a bolt including a head engaging said front end wall, and a shank passing through said aligned apertures and including a threaded portion threadedly engaged in said threaded hole in said rear wall.

7. A marine propulsion device comprising a propulsion unit including a cavity defined in part by a wall, means defining an opening communicating with said cavity, a rubber mount insertable into said cavity through said opening, said rubber mount including a central core having therein an axially extending aperture with a first threaded end adapted to be connected to an arm of a kingpin, a second threaded end, and a stop member having a shank threaded into said second end of said core and an enlarged head portion including a peripheral part located for engagement with said cavity to prevent withdrawal of said core from said cavity independently of the remainder of said rubber mount, and means insertable through said opening and located in said cavity, securable to said propulsion unit, and engageable with said rubber mount for fixedly securing said rubber mount to the propulsion unit and between said insertable means and said wall of said cavity.

8. A marine propulsion device comprising a propulsion unit including a rigid assembly which comprises a power head and a drive shaft housing and which includes therein a cavity having a pair of internal side walls spaced at a first dimension, means for defining an opening communicating with said cavity and having a dimension which extends parallel to said dimension between said side walls and which is less than said dimension between said side walls, a pair of rubber mounts inserted into said cavity through said opening and respectively located in said cavity adjacent said side walls, means inserted through said opening and located between said rubber mounts for engagement with said rubber mounts to secure said rubber mounts in engagement with said side walls, and means for releasably connecting said inserted means to said propulsion unit.

9. A marine propulsion as set forth in claim 8 and further comprising a kingpin engaging said rubber mounts independently of said inserted means so that said propulsion unit is supported relative to said kingpin by said rubber mounts.

10. A marine propulsion device comprising a propulsion unit including a cavity having a pair of internal side walls spaced at a first dimension, means for defining an opening communicating with said cavity and having a dimension which extends parallel to said dimension between said side walls and which is less than said dimension between said side walls, a pair of rubber mounts insertable into said cavity through said opening and respectively located in said cavity adjacent said side walls, means insertable through said opening and located between said rubber mounts for engagement with said rubber mounts to secure said rubber mounts in engagement with said side walls, said insertable means comprising a pair of wedge-shaped blocks located between said rubber mounts, each of said blocks including a side surface and a wedge surface in inclined relation to said side surface, said inclined wedge surface being in engagement, and means for releasably connecting said insertable means to said propulsion unit and for displacing said blocks relative to each other and along said inclined surfaces to increase the distance between said side surfaces and to engage said side surfaces of said blocks with said rubber mounts so as to secure said rubber mounts between said side walls of said cavity and said side surfaces of said blocks.

11. A marine propulsion device in accordance with claim 10 wherein said rubber mounts each include an outer shell having a cylindrical outer surface defined by a radius, wherein said side walls of said cavity are generally semi-cylindrical in shape and have a radius substantially equal to said outer surface radius, and wherein said side surfaces of said one of said blocks are generally semi-cylindrical in shape and have a radius substantially equal to said outer surface radius.

12. A marine propulsion device in accordance with claim 10 wherein said means for displacing said blocks relative to each other comprises a rear wall located in said cavity and having therein a threaded hole, a rear end wall on one of said blocks and located adjacent said cavity rear wall, a front end wall on the other of said blocks, aligned apertures in said blocks and extending from said front end wall to said rear end wall, and a bolt including a head engaging said front end wall, and a shank passing through said aligned apertures and including a threaded portion threadedly engaged in said threaded hole in said rear wall.

13. A first propulsion device comprising a propulsion unit including a cavity having a pair of internal side walls spaced at a first dimension, means for defining an opening communicating with said cavity and having a dimension which extends parallel to said dimension between said side walls and which is less than said dimension between said side walls, a pair of rubber mounts insertable into said cavity through said opening and respectively located in said cavity adjacent said side walls, said rubber mounts each including a central core having therein an axially extending aperture with a first threaded end adapted to be connected to an arm of a kingpin, a second threaded end, and a stop member having a shank threaded into said second end of said core and an enlarged head portion including a peripheral part located for engagement with said cavity to prevent withdrawal of said core from said cavity independently of the remainder of said rubber mount, means insertable through said opening and located between said rubber mounts for engagement with said rubber mounts to secure said rubber mounts in engagement with said side walls, and means for releasably connecting said insertable means to said propulsion unit.

14. A marine propulsion device comprising a propulsion unit including a cavity having a pair of internal side walls spaced at a first dimension and being substantially semi-cylindrical in shape and defined by a first radius, and a rear wall having a threaded hole, means for defining an opening communicating with said cavity and having a dimension which extends parallel to said dimension between said side walls and which is less than said dimension between said side walls, a pair of rubber mounts insertable into said cavity through said opening and respectively located in said cavity adjacent said side walls, said rubber mounts each including an outer shell having a cylindrical outer surface defined by a second radius substantially equal to said first radius, a central core having therein an axially extending aperture with a forward threaded end adapted to be connected to an arm of a kingpin, and a rearward threaded end, and a stop member having a shank threaded into said rearward end of said core and an enlarged head portion including a peripheral part located for engagement with said cavity to prevent withdrawal of said core from said cavity independently of the remainder of said rubber mount, a pair of wedge-shaped blocks insertable through said opening and located between said rubber mounts, each of said blocks including a side surface of substantially semi-cylindrical shape with a third radius substantially equal to said first radius, and a wedge surface in inclined relation to said side surface, said inclined wedge surfaces being in engagement, one of said blocks including a rear end wall located adjacent said cavity rear wall, the other of said blocks including a front end wall, aligned apertures in said blocks and extending from said front end wall to said rear end wall, and a bolt including a head engaging said front end wall, and a shank passing through said aligned apertures and including a threaded portion threadedly engaged in said threaded hole in said rear wall, whereby to afford lateral displacement of said blocks relative to each other so as to increase the distance between said side surfaces and to engage said side surfaces of said blocks with said rubber mounts to secure said rubber mounts between said side walls of said cavity and said side surfaces of said blocks.

* * * * *